United States Patent [19]

Berney

[11] 4,425,538

[45] Jan. 10, 1984

[54] TIMEPIECE WITH A DEVICE FOR THE CONTROL OF A STEPPING MOTOR

[75] Inventor: Jean-Claude Berney, Epalinges, Switzerland

[73] Assignee: Jean-Claude Berney SA, Epalinges, Switzerland

[21] Appl. No.: 233,087

[22] Filed: Feb. 10, 1981

[30] Foreign Application Priority Data

Feb. 19, 1980 [CH] Switzerland ..... 1320/80

[51] Int. Cl.[3] ..... G04F 5/00

[52] U.S. Cl. ..... 318/696; 368/157

[58] Field of Search ..... 310/49 R; 318/696; 368/10, 62, 66, 76, 80, 85, 156, 157, 159, 188, 217

[56] References Cited

U.S. PATENT DOCUMENTS 4,208,868 6/1980 Regnier et al. ..... 368/62

*Primary Examiner*—J. V. Truhe

*Assistant Examiner*—Saul M. Bergmann

*Attorney, Agent, or Firm*—Wender, Murase & White

[57] ABSTRACT

The timepiece includes a detector of the direction of the current in the winding of the motor which is used to detect the first reversal in current direction after the end of the driving pulse and to deliver a signal which is representative of this current direction. A comparator circuit (34–36, 38, 39, 48) is used to compare the moment of the appearance of this signal with a reference time which is fixed in relation to the driving pulse and to control a circuit (28–31, 33, 40, 44, 51, 46, 47) which controls the duration of the driving pulses in such a way that the instant at which the signal appears coincides with the reference time. This enables minimum energy to be imparted to the motor for a given variable load.

13 Claims, 6 Drawing Figures

TIMEPIECE WITH A DEVICE FOR THE CONTROL OF A STEPPING MOTOR

BACKGROUND OF THE INVENTION

The present invention relates to a timepiece with a device for controlling a stepping motor which includes an oscillator, a frequency divider connected to the said oscillator in order to produce a plurality of control signals and a control circuit which is connected at least indirectly to the said frequency divider for delivering driving pulses to the said motor.

In electronic timepieces which include a stepping motor, it is useful to be able to match the energy of the driving pulses to the motor load in such a way as to achieve the lowest possible power consumption while retaining full reliability of operation. Known systems, for example, use an excess motor load detector which can be used to alter the duration or the amplitude of the average driving pulses to a higher value when excess load is detected. Other systems use an unperformed step detector by means of which additional higher energy compensating pulses are emitted when an unperformed step is detected. These, in fact, are safety systems which can be used merely to deliver extra energy when such is needed. The driving pulses are therefore not matched at all times to the motor load. More advanced systems, which also use an unperformed step detector, can be used to determine periodically the operating limit of the motor by progressively reducing the energy of the driving pulses. When an unperformed step is detected the energy of the driving pulses is fixed at a value which is slightly higher than the limit found so as to ensure that the motor operates with sufficient reliability. This limit of course depends on the motor load, so that on average the energy of the impulses is matched to the motor load. This matching process is slow however. In fact, the system requires the periodic emission of compensating signals which consume energy, which is contrary to the intended aim. In order to minimise this defect, the operating limit can only be determined at well spaced intervals, and the energy of the driving pulses cannot be matched to rapid changes in load which occur between two determinations of the limit. Here again the system does not permit matching to the motor load to be effected continuously and rapidly.

SUMMARY OF THE INVENTION

The object of this invention is to correct these defects by providing a control device in which the energy of the driving pulses depends directly on the time taken by the rotor to effect all or part of a step, this energy being matched to each step in relation to changes in the time required for its performance.

By making the performance time equal to a value which is judiciously chosen in relation to the motor type, the moment of inertia of the rotor, the starting torque, etc., by means of a control circuit, changes in the motor load are taken into account at all times while a virtually constant safety margin is maintained, even when there are rapid variations in the load. Mechanisms, date indicating devices, contacts, etc. can therefore be operated without danger and without disturbing the system. Except in exceptional cases it is not therefore necessary to provide making up impulses, even if the safety margin is set very low, e.g. only 10% above the operating limit of the motor.

According to the present invention there is provided a timepiece with a device for the control of a stepping motor, comprising an oscillator, a frequency divider connected to the said oscillator for delivering a plurality of control signals, a control circuit which is connected at least indirectly to the said frequency divider for delivering driving pulses to the said motor, wherein the device for the control of the stepping motor is associated with a detector which delivers a signal when a particular point in the characteristic of the current in the motor winding is reached, the appearance of this point being related to the time taken by the rotor to make one step, this time being variable as a function of load, the said timepiece also including means to vary the energy supplied to the said motor by the said driving pulses as a function of variations in the time of the appearance of the said signal in relation to the driving pulse.

BRIEF DESCRIPTION OF THE DRAWINGS

The invention will be described below, by way of example with reference to the accompanying drawings, in which.

DESCRIPTION OF THE PREFERRED EMBODIMENT

Figure 6:
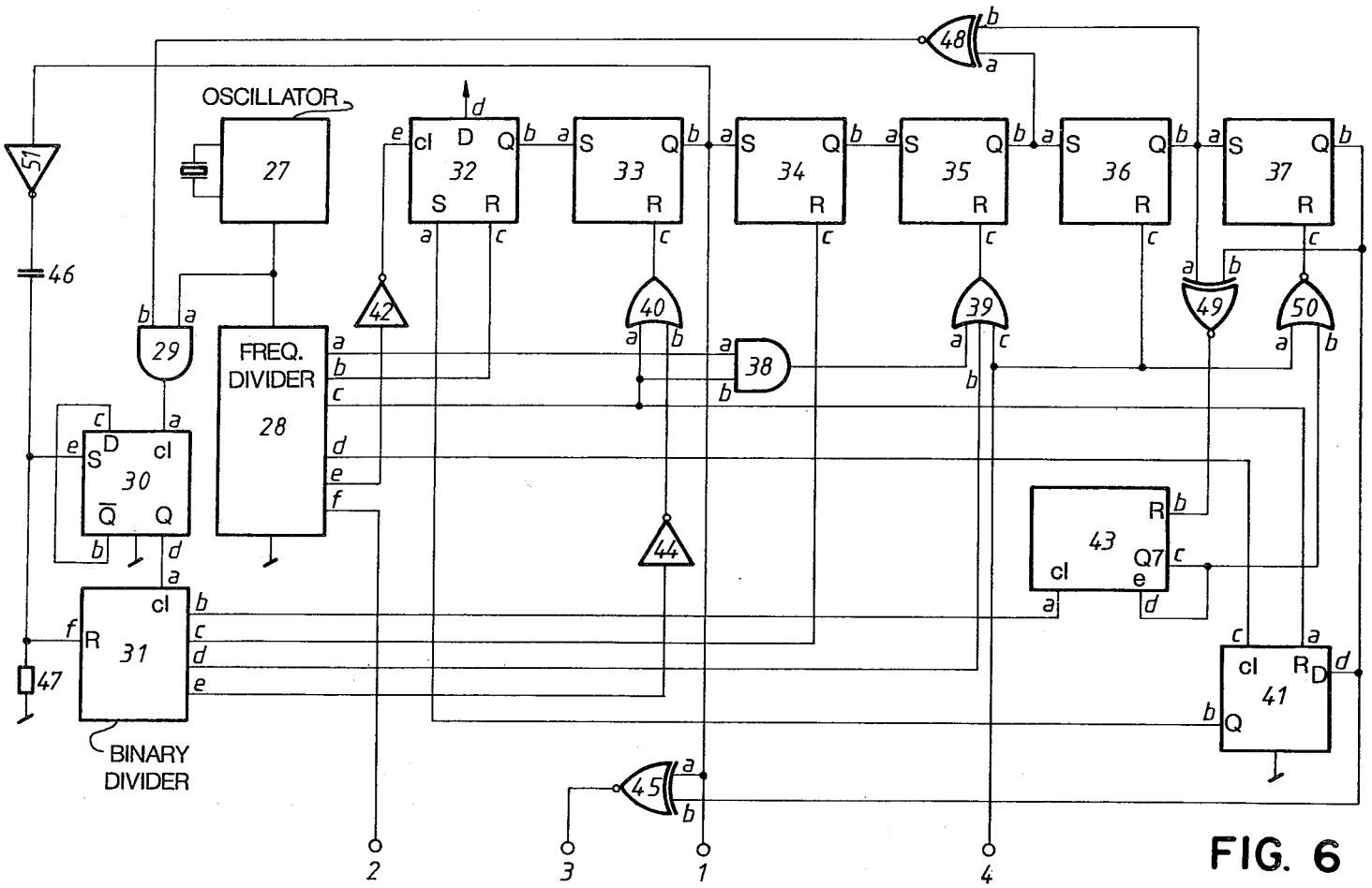
FIG. 6 is a block diagram of the control device according to the present invention.

In FIGS. 1–4 the motor current $I_M$ is represented by a solid line, the induced current $I_i$ is represented by the dashed line and the computing time of counter 43 in FIG. 6 is represented by the reciprocal of the output voltage from gate 49, $\overline{V}_{49}$. In these FIGS. 1–4, t1 represents the end of the driving pulse, t2 represents the start of determination of the direction of the induced current in the motor winding at a fixed time interval after the end of the driving pulse (2 ms in the example in FIGS. 1–4) and t3 represents the time of the second reversal in the induced current.

Point A indicates the first reversal in the induced current, the appearance of this reversal corresponding approximately to the moment at which the motor completes its step. Point A can therefore be used to control the time during which the rotor is in motion.

Figure 1:
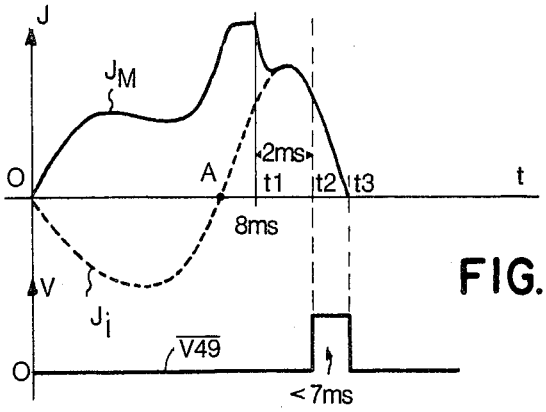
FIGS. 1–4 are voltage/current versus time curves which represent motor current $I_M$ and induced current $I_i$ in the winding of the stepping motor as well as a signal $\overline{V}_{49}$ which illustrates the computing time of the counter 43 in FIG. 6 according to the present invention.
Figure 2:
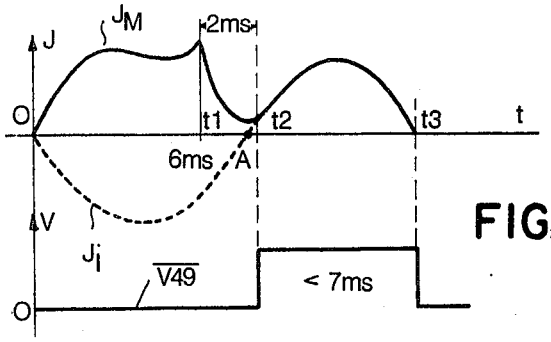

In FIGS. 1 and 2, which refer to driving pulses of 8 ms and 6 ms respectively, the motor receives too much energy and point A arrives too soon to be detected. This "pulse too long" condition may be detected by the fact that the polarity of the induced current in the coil is already reversed after a fixed interval for discharge of the self-inductance of the motor (in this case 2 ms): the direction of the current is the same as that of current $I_M$. On the other hand, in the case of FIG. 3 in which the duration of the driving pulse, which is fixed at 4 ms, approaches the minimum, the polarity of the induced current has not yet reversed after the fixed interval of 2 ms. Point A which corresponds to the moment of the first reversal of the induced current can therefore be detected accurately, and the moment at which point A appears in the control circuit can be taken into account.

Figure 4:
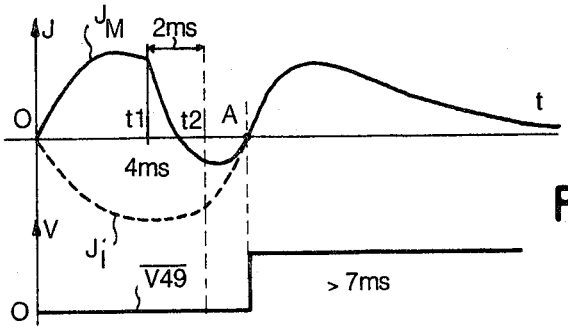

In FIG. 4 the energy of the pulse is too low, and the rotor does not make its step. It is still possible to detect a reversal in the polarity of the induced current, which the control circuit might equate to point A. This reversal in the polarity of the induced current corresponds to the reversal of the direction of rotation of the rotor which returns to its starting point.

In order to avoid possible disturbance to the control circuit a safety circuit must be provided in order to detect steps which are not effected.

Figure 3:
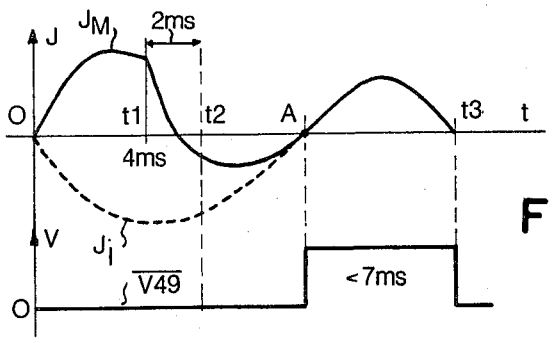

When a step has been correctly effected, as in FIGS. 1, 2 and 3, the half-wave which corresponds to the first reversal of the induced current results in over-run of the equilibrium point due to the effect of the speed acquired by the rotor. The end of this half-wave, at t3, corresponds to the time when the rotor stops as a result of the magnetic restoring force in the air gap.

The duration of this half-wave after the first reversal of the induced current is therefore determined essentially by the moment of inertia of the rotor and the magnetic field in the gap, values which are stable and reproducible. Thus if the energy of the driving pulses is reduced the time during which the rotor is in motion is increased (displacement of point A) and the speed of the rotor is reduced (reduction in the amplitude of the induced current); on the other hand the duration of the half-wave after the first reversal in the induced current is effectively constant. Also when the rotor fails to effect a step (FIG. 4) this half-wave corresponds to the return of the rotor in reverse from the time at which it stops. As its initial speed is zero this return takes place relatively slowly and the duration of this half-wave is very much longer than in the previous cases. It is therefore possible to detect steps which have not been effected by simply measuring the duration of this half-wave.

It is obvious that another characteristic point in the current curve which is related to the time taken by the rotor to make all or part of a step could be used in the control circuit.

Figure 5:
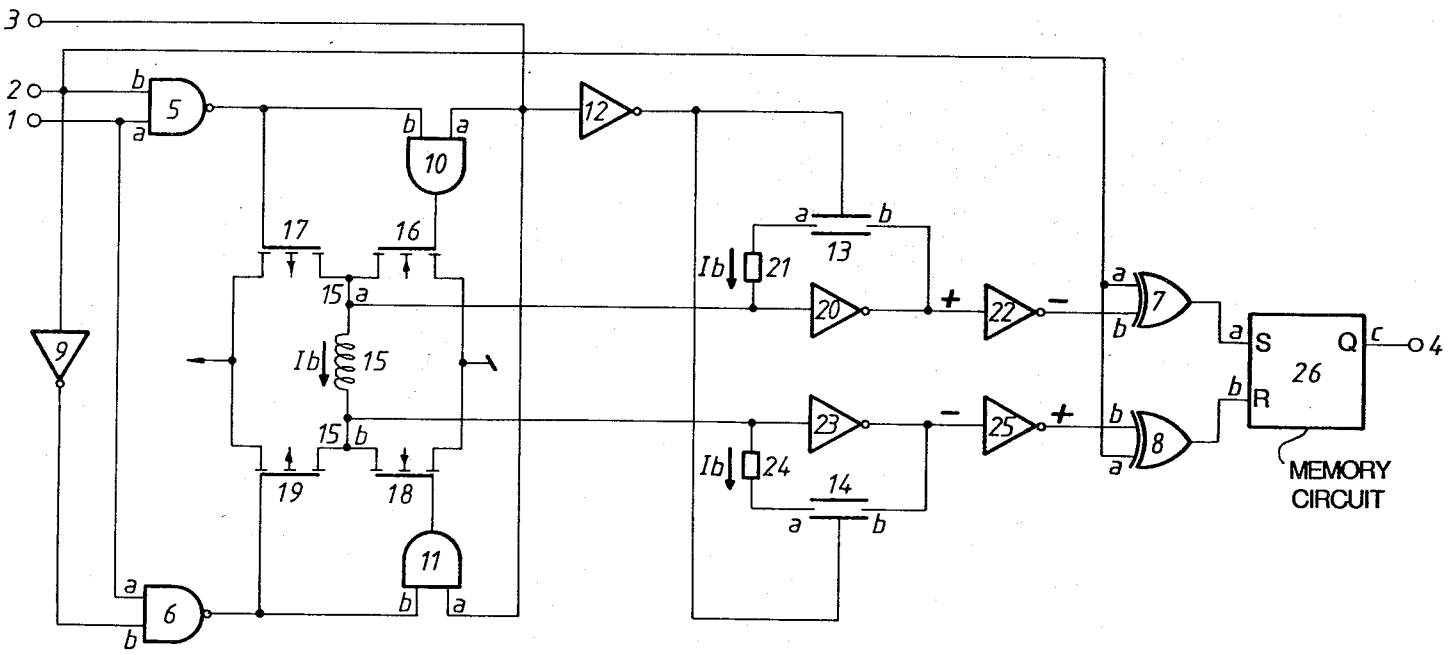
FIG. 5 is a schematic diagram of the motor control circuit associated with a detector of the direction of the current in the motor winding according to a preferred embodiment of the present invention.

However, as point A occurs at the place where the polarity of the current reverses a relatively simple and accurate polarity detector such as that illustrated in FIG. 5 can be used.

In order to simplify the description of the polarity detector the latter is only shown in FIG. 5 in association with the motor control circuit. This sub-assembly is connected via terminals 1, 2, 3 and 4 to the circuit of FIG. 6 which includes the other components which are essential to the clock circuit. At point 1 there is a signal which corresponds to the driving pulses, at point 2 there is a signal which corresponds to the polarity of the driving pulses, at point 3 there is a signal for engaging the polarity detector, while at point 4 there is the output signal from this detector, this signal corresponding to the polarity of the current in the winding.

Input 1, which receives positive pulses having the duration of the driving pulses, is connected to the inputs a of two NAND gates 5 and 6. The polarity input 2 is connected to input b of the NAND gate 5, to the inputs a of two EXCLUSIVE-OR gates 7 and 8 and to the input to an inverter 9, the output of which is connected to input b of gate 6. Input 3 for engagement of the polarity detector is connected to the inputs a of two AND gates 10 and 11, and to the input of an inverter 12, whose output is connected to the control inputs of two transmission gates 13 and 14. The motor winding 15 is connected to the drains of four complementary MOS power transistors 16, 17, 18 and 19 forming a bridge circuit. The source of N-type transistor 16 is connected to the negative pole of the supply and its gate is connected to the output of gate 10. The source of P-type transistor 17 is connected to the positive pole of the supply and its gate to the output of gate 5 and to the input b of gate 10. The source of transistor 18 is connected to the negative pole of the supply and its gate is connected to the output gate 11. The source of transistor 19 is connected the the positive pole of the supply and its gate to the output of gate 6 and to the input b of gate 11.

If input 3 is at 1 this control circuit behaves in the conventional way and feeds the motor with pulses of alternating polarity. In fact, if there is no pulse at input 1, the outputs from gates 5, 6, 10 and 11 are at 1. The two N-type transistors 16 and 18 conduct while the P-type transistors 17 and 19 are blocked. Coil 15 is therefore short circuited to the negative pole of the supply. When an impulse arrives two cases are possible. If input 2 is at 1 input b of gate 5 is at 1 and input b of gate 6 is at 0. The outputs from gates 5 and 10 change to 0 while the outputs from gates 6 and 11 remain at 1. Transistors 17 and 18 then conduct while transistors 16 and 19 are blocked. Terminal 15*a* of coil 15 changes to 1 and current flows in the winding in the direction a-b.

If input 2 is at 0 terminal b of gate 5 is at 0 while input b of gate 6 is at 1. As a result the outputs from gates 6 and 11 change to 0 at the time of the driving pulse while the outputs from gates 5 and 10 remain at 1. Transistors 16 and 19 then conduct while transistors 17 and 18 are blocked. Terminal 15*b* of coil 15 then changes to 1 and a current flows in the winding in the direction b-a.

Terminal 15*a* of coil 15 is also connected to the input of an inverting amplifier 20 and through a resistor 21 to input a of transmission gate 13 whose output b is connected to the output of inverter 20 and to the input of a second inverter 22, whose output is connected to input b of the EXCLUSIVE-OR gate 7.

Terminal 15*b* of coil 15 is also connected to the input of an inverting amplifier 23 and through a resistor 24 to input a of transmission gate 14 whose output b is connected to the output of inverter 23 and to the input of a fourth inverter 25 whose output is connected to input b of the EXCLUSIVE-OR gate 8.

The outputs from gates 7 and 8 are connected respectively to the set a and zero reset b inputs of a memory 26 (RS latch). The four inverters 20, 22, 23 and 25 comprise single pairs of complementary MOS transistors. These are similarly dimensioned and it can be assumed that their threshold input voltages are virtually the same because they are integrated in the same circuit. These four amplifiers are the components of the polarity detector for the current in the winding. This detector works as follows.

At the end of the driving pulse input 3 changes to 0. The outputs from gates 10 and 11 therefore change to 0. As the outputs of gates 5 and 6 are at 1 the four transistors 16, 17, 18 and 19 in the control circuit are blocked. The motor control circuit is therefore placed completely out of action for an instant. Coil 15 would therefore be in the air if the output from amplifier 12 had not simultaneously changed to 1, making gates 13 and 14 conducting. Amplifiers 20 and 23 are therefore brought into action and are respectively biased by the feedback resistors 21 and 24. Thus terminals a and b of coil 15 change to a potential which is close to the input threshold voltage of amplifiers 20 and 23 and the induced current can flow through resistances 21 and 24 producing voltage drops in the latter which are amplified by amplifiers 22 and 25.

The current direction in FIGS. 1-4 has been drawn for the case in which input 2 is at 1. During the driving pulse current flows from terminal a to terminal b. If this polarity is maintained after the impulse, the output from amplifier 20 changes to 1 and the output of amplifier 23 changes to 0 which allows the current to flow from the output of amplifier 20 through resistor 21, then through coil 15 and resistor 24 on the output of amplifier 23.

At this instant the output from amplifier 22 is at 0 and the output from amplifier 25 is at 1. As the inputs a of gates 7 and 8 are at 1 these gates act as inverters. Input a of gate 26 is therefore at 1 and input b of the same gate is at 0. The set input a of memory 26 then becomes activated and output c of the memory is at 1.

If the current in the winding reverses the above process is also reversed. The output from amplifier 23 changes to 1 and the output from amplifier 20 changes to 0 so that the current can now flow from the output of amplifier 23 through resistor 24 from terminal b to terminal a of the motor winding then through resistor 21 at the output of amplifier 20. The output from gate 8 is then at 1 and it is the zero reset input b of memory 26 which is activated. Output c of this memory 26 then changes to 0.

When input 2 is at 0 the polarity of the current in the winding reverses but gates 7 and 8 no longer act as inverters so that conditions become as they were before, i.e.:

output c of memory 26 is at 1 when the current in the winding has the same polarity as during the driving pulse (positive direction);

output c of memory 26 is at 0 when the current in the winding has the opposite polarity to that during the driving pulse (negative direction).

It is clear that as it is no longer necessary to know the polarity of the current, input 3 is returned to 1 which puts amplifiers 20 and 23 out of action and again renders transistors 16 and 18 conducting, the outputs from gates 10 and 11 having changed to 1.

In order to limit the consumption of the amplifiers even further, they may also only be brought into service sequentially for very short periods of time, the current polarity being the memorized between successive operating periods.

FIG. 6, which shows the other essential circuits of the timepiece, shows a quartz oscillator 27 connected to the input of a frequency divider 28 and the input a of an AND gate 29 whose output is connected at the clock input to a D-type flip-flop FF30 connected as a divide-by-two circuit, its Q output (b) being connected to its D input (c). Its $\overline{Q}$ output (d) is connected to the clock input a of a binary divider 31 which is therefore in parallel with the frequency divider 28. In the following we assume that the dividers are activated on the negative edges of their clock impulses while the counters are activated on the positive edges of their clock impulses. The circuit also includes a shift register which is used to determine the sequence of operations. The shift register comprises the D-type flip-flop FF32 whose D input (d) is connected to the positive pole of the supply and NOR memories (NOR RS latches) 33, 34, 35, 36 and 37 whose set inputs (a) are connected to the Q output (b) of the preceding stage.

Divider 28 delivers several frequencies from its outputs:

| | | |
|---|---|---|
| a = 256 Hz (2ms) | c = 64 Hz (8ms) | e = 1 Hz |
| b = 128 Hz (4ms) | d = 16 Hz (30 ms) | f = 0.5 Hz |

All the outputs change simultaneously to 0 when the 1 Hz signal appears; the delay after which they return to 1 is shown in brackets.

The divider 31 also delivers several output frequencies (here the delay is given in relation to output e of divider 31):

| | |
|---|---|
| b = 1 kHz (0.5 ms) | d = 128 Hz (4 ms) |
| C = 256 Hz (2 ms) | e = 32 Hz (16 ms) |

The output a of divider 28 is connected to the input a of an AND gate 38 whose output is connected to the input a of an OR gate 39.

Output b of divider 28 is connected to the zero reset input c of FF32. Output c of the divider is connected to the input a of an OR gate 40 whose output is connected to the zero reset input c of memory 33, to input b of the AND gate 38 and to the zero reset input a of a D-type flip-flop FF41 whose Q output (b) is connected to the set input a of FF32.

Output d of divider 28 is connected to the clock input c of FF 41. Output e of the divider is connected to the input of an inverter 42 whose output is connected to the clock input e of FF32. Output f of the divider is connected to terminal 2 and determines the polarity of the driving pulses.

The circuit is designed for example to advance the motor by one step per second and the 0.5 Hz signal from output f of divider 28 is used to reverse the polarity every second. Output b of divider 31 is connected to the clock input a of a Johnson divide-by-eight counter (43).

Output c of divider 31 is connected to the zero reset input c of memory 34. Output d of divider 31 is connected to input b of the OR gate 39 whose output is connected to the zero reset input c of memory 35. The output e of divider 31 is connected to the input of an inverter 44 whose output is connected to the input b of the OR gate 40.

Output b of memory 33 is connected to terminal 1, to the input a of an EXCLUSIVE-NOR gate 45 whose output is connected to terminal 3 and through inverter 51 and capacitor 46 to the set input e of FF30 and the zero reset input f of divider 31, as well as to a resistor 47 which is connected to the negative pole of the supply. Output b of memory 35 is connected to the input a of an EXCLUSIVE-NOR gate 48 whose output is connected to input b of AND gate 29. Output b of memory 36 is connected to input b of gate 48 and to the input a of an EXCLUSIVE-NOR gate 49 whose output is connected to the zero reset input b of counter 43.

Output b of memory 37 is connected to input b of gate 49 and to input d of FF41 and input b of gate 45.

Finally terminal 4 is connected to input c of gate 39, to the zero reset input c of memory 36 and the input a of a NOR gate 50 whose output is connected to the zero reset input c of memory 37. Input b of gate 50 is connected to output Q7 (c) of the Johnson counter 43 and to the clock enable input d of this counter 43.

The above circuit works as follows. It is known that the set input has priority in memories of the "RS NOR latch" type. Thus a memory in the shift register formed by circuits 32 to 37 cannot be reset to zero unless the preceding stage has already been set to 0.

Also in EXCLUSIVE-NOR gates the output is at 1 when the two inputs are at the same state. Thus between impulses the b outputs of circuits 32 to 37 are at 0 and the outputs from gates 45, 48 and 49 are at 1. AND gate 29 is open and the signal present at its input a is transmitted to the clock input a of FF30. Counter 43 is reset to zero and remains at 0. Finally terminal 3 is at 1 and the polarity detector in FIG. 5 is out of action.

When the 1 Hz frequency output e of divider 28 changes to 0 the output of amplifier 42 changes to 1 and changes over FF32 whose Q output (b) changes to 1, which in turn induces the memories 33 to 37 to change successively to 1. Terminal 1 changes to 1 and the control circuit in FIG. 5 begins to deliver a control impulse to the motor whose polarity is determined at terminal 2 by the state of 0.5 Hz frequency output f of divider 28.

After 4 ms output b of divider 28 changes to 1 which activates the zero reset c of FF32 whose output changes to 0. This 4 ms delay determines the minimum duration of the driving pulses.

Since output b of FF32 is at 0, memory 33, which determines the duration of the driving pulses, can change to 0 once the output of inverter 44 changes to 1, which corresponds to a return to 0 of output e of divider 31. If this output e of divider 31 has not changed to 0, 8 ms after the start of the pulse, output c of divider 28 changes to 1 causing memory 33 to be reset to zero. Output c of divider 28 therefore fixes the maximum duration for a driving pulse at 8 ms.

However as a general rule it is output e of divider 31 which changes to 0 first and which thus determines the duration of the driving pulse. The start of the driving pulse is thus determined by frequency divider 28 and the end of the pulse at time t1 is thus determined by the divider 31, the difference in phase between these two dividers determining the duration of the driving pulses. At the end of the driving pulse (terminal 1, output b of memory 33) at t1 the output of inverter 51 changes to 1. A narrow pulse is produced by capacitor 46 at the zero reset input f of divider 31 and at the set input e of the divide-by-two circuit 30. This divider 30 then changes from 0 to 1 and takes an advance by 1 step. If it is assumed that the frequency of the clock signal at input a of this divider is 32768 Hz the corresponding output period at terminal e of divider 31 is shortened by about 30 μs. This shortening is expressed in a forward phase shift in the divider 31, with respect to divider 28, a phase shift which in turn brings about an equivalent shortening of the subsequent motor pulses.

This phase shift is therefore produced systematically at the end of each driving pulse and as long as input b of gate 29 remains at 1 it causes regular shortening of the duration of the driving impulses by 30 μs per step.

At the end of the impulse, at t1, the output from gate 45 changes to 0 which brings into action the polarity detector in FIG. 5. Memory 34 can then return to 0 as soon as output c of divider 31 changes to 1 at t2, or exactly 2 ms after the end of the driving pulse. After this delay, as we have seen in FIGS. 1 to 4, the inductance of the motor is discharged and a start can be made on determining the polarity of the current in the winding on the basis of the signal produced by the polarity detector on terminal 4.

If we refer to FIGS. 1 and 2 it can be seen that the polarity of the induced current is already positive at t2, after the 2 ms delay, which is equivalent to an excessively long pulse duration. Memories 35 and 36 therefore change simultaneously to 0 so that the output from gate 48 remains at 1, as does input b of gate 29. The forwards phase shift of divider 31 is thus preserved and results in a shortening of the next pulse.

As memory 36 is at zero and memory 37 is at 1, the output from gate 49 changes to 0 which frees the zero reset of counter 43 which then increases its contents by 1 step per millisecond from the end of the 2 ms delay at t2. In the examples in FIGS. 1, 2 and 3 it will be seen that the induced current curve $I_i$ becomes confounded with the motor current curve $I_M$ at a certain time after the end of the driving pulse and that the polarity of the induced current again reverses at t3, less than 7 ms after the liberation of counter 43 at t2. As a result terminal 4 changes to 0 at t3. As output Q7 (c) of counter 43 being still at 0 the output of NOR gate 50 changes to 1 at t3 and resets memory 37 to 0.

Counter 43 can therefore be used to measure the duration of the first current cycle induced in the winding at t2 after the 2 ms delay at the end of the driving pulse at t1. When this period is less than the value predetermined by the capacity of counter 43 and the frequency of the clock signal, 7 ms in the example described, the sequence of operations is interrupted and the shift register is entirely reset to 0.

Thus as long as input 4 which is connected to the output of the polarity detector for the current in the winding changes to 1 before the a and b inputs of gate 39 memories 35 and 36 are reset to 0 simultaneously. The output from gate 48 thus remains at 1 all the time and the duration of the driving pulses decreases regularly.

In other words when the appearance of point A precedes the reference times fixed at the a and b inputs of gate 39 the control circuit reacts in such a way that the duration of the driving pulses decreases. This decrease applies slowly and regularly in steps of 30 μs.

The reference time for inputs a and b of gate 39 is fixed as follows. Input a of gate 39 changes to 1, 10 ms after the start of the driving pulse, while input b of the same gate changes to 1, 4 ms after the end of the driving pulse. If the duration of the driving pulse is less than 6 ms input b of gate 39 changes to 1 before input a of the same gate and causes memory 35 to be reset to zero. Conversely if the duration of the driving pulse is greater than 6 ms input a of 39 changes to 1 before input b of the same gate and therefore has priority.

The reason for this particular arrangement is as follows:

When the duration of the pulse becomes very short this means that the motor is under little load and the rotor accelerates very rapidly. An attempt to impose too long an operating time on the rotor could then result in an impossible situation. It is therefore preferable that the operating time (reference time) should be reduced as the duration of the pulse becomes shorter. This is achieved automatically by fixing the reference time in relation to the end of the driving pulse. In our example this time is 4 ms. On the other hand if the duration of the pulse has a high value this means that the rotor is heavily loaded and that the rotor moves slowly. It is then necessary to apply a wide safety margin by fixing a maximum for the rotor operating time so that the rotor can retain a certain reserve of kinetic energy. This maximum reference time can only be fixed with respect to the start of the pulse. In our example this time is 10 ms.

We have seen that the duration of the pulses in FIGS. 1 and 2 is too long. The pulse will therefore shorten and this has the effect of displacing point A to the right. A certain time after the 2 ms delay the polarity of the current at terminal 4 will be negative. It is therefore possible to detect the point A which corresponds to the instant when the polarity at terminal 4 becomes positive. However the pulse continues to shorten as long as point A arrives before the reference time. At the moment when point A arrives after the reference time, as in the case of FIG. 3, (more than 4 ms after the end of the pulse or more than 10 ms after the beginning of the pulse), terminal 4 is at 0 at the end of the driving pulse and memory 35 changes to 0 at the reference time, while memory 36 changes to 0 at the time when terminal 4 changes to 1, i.e. when the current direction becomes again positive, i.e. when point A appears. There is therefore a delay between the 0 resets of memories 35 and 36, a delay during which the output of gate 48 changes to 0, blocking the clock input of divider 30. Divider 31 then lags behind divider 28, a phase lag which results in a corresponding extension of the duration of the driving pulses. If the delay is 30 μs the control system is in equilibrium and the duration of the driving pulses is stable because this delay exactly cancels the advance of 30 μs imparted at the end of the driving pulse. If the load torque decreases slightly the rotor moves more quickly and point A arrives before the reference time, thus tending to shorten the duration of the driving pulses and vice versa. The system therefore tends to ensure that point A appears simultaneously with the reference time, i.e. it definitively controls the time taken by the rotor in making a step.

We would point out that if the duration of the impulses decreases slowly, in steps of 30 μs, the increase in duration is directly linked to the delay between the appearance of the reference time and the appearance of point A. If the motor load torque should suddenly increase this delay may be several milliseconds long. This lack of symmetry between the shortening and the lengthening of the driving pulses, which is associated with the arrangement which controls the phase of divider 31, makes it possible, in fact, to match the duration of the pulses rapidly to sudden variations in load while avoiding oscillation in the control loop and, in fact, ensures maximum operating reliability.

Finally let us see what happens in the case of FIG. 4. In certain exceptional cases the motor load may increase so much and so suddenly that the duration of the pulses cannot be matched quickly enough. The rotor is therefore unable to make its step.

In this case memory 36 returns to 0 at point A and the output of gate 49 changes to 0. Counter 43 counts and at the end of 7 ms its output Q7 (c) changes to 1, which activates the clock enable input d, blocks counter 43 at 7 and blocks the output from gate 50 at 0. Memory 37 cannot then be reset to 0 and at the end of 30 ms output d of divider 28 changes to 1 and changes over FF41 to 1. Output Q (b) of FF41 changes to 1 and activates the set input a of FF32. This FF32 changes to 1 as does the shift register formed by stages 33 to 37, which restarts the sequence of operations. The set input a of FF32 remains at 1 for 8 ms, at which time output c of divider 28 changes to 1 and sets FF41 to 0.

The making up pulse produced in this way thus lasts for at least more than 8 ms so as to ensure that the rotor terminates its step.

Thus when counter 43 measures a positive half-wave of more than 7 ms (see FIG. 4) movement of the rotor is ensured by delivering a making up pulse of maximum duration which ensures maximum reliability for the system.

It is quite clear that the safety circuit described above can be used with other devices for the control of the driving pulses which use other types of detectors or other types of control circuit for example. Similarly the detection circuits and the control circuits described above are given by way of example, numerous other variants in terms of combinations of circuits, sequences of operation and the selection of different delays and reference times being possible.

What I claim is:

1. A timepiece comprising:

a stepping motor including a coil and a rotor;

an oscillator for providing a standard frequency signal;

a frequency divider connected to said oscillator for dividing down said standard frequency signal and delivering a plurality of periodic signals of different frequencies;

a motor control device connected to said frequency divider and comprising a driver circuit for applying current driving pulses to said coil; and detecting means for delivering a signal when a particular point in the characteristic of the current in said coil appears, the time of the appearance of said particular point being variable as a function of the load of the motor;

said motor control device further including control means receiving the signal delivered by said detecting means and acting on said driver circuit to vary the energy supplied to said motor by said driving pulses in proportion to the variations of the time of the appearance of said particular point in the characteristic of the current in the coil with respect to the driving pulse, this change in the energy being effected in a single step at least when the variation of the time of the appearance of said particular point with respect to the driving pulse corresponds to an increase in the load of the motor.

2. A timepiece according to claim 1, wherein said control means varies the duration of the driving pulses.

3. A timepiece according to claim 2, wherein said control means comprises a first control circuit which compares the time of the appearance of the signal delivered by the detecting means with a reference time fixed with respect to the driving pulse, and a second control circuit permitting to progressively shorten the duration of the driving pulses by steps equivalent to the period of said standard frequency signal or of one of said periodic signals and to lengthen the duration of the driving pulses by an amount determined by the difference between the time corresponding to the appearance of said particular point in the current characteristic and said reference time.

4. A timepiece according to claim 3, wherein the start of the driving pulses is determined by one of the periodic signals delivered by the frequency divider and wherein said control circuit comprises a parallel frequency divider which determines the end of the driving pulses and means for altering the phase of said parallel frequency divider with respect to said frequency divider, the phase difference between the two dividers being used to vary the duration of the driving pulses.

5. A timepiece according to claim 3, wherein said reference time is fixed with respect to the start of the driving pulse.

6. A timepiece according to claim 3, wherein said reference time is fixed with respect to the end of the driving pulse.

7. A timepiece according to claim 3, wherein said reference time is fixed with respect to the start of the driving pulse when the duration of the said pulse is larger than a predetermined value and to the end of the driving pulse when the duration of this pulse is smaller than said predetermined value.

8. A timepiece according to claim 1, wherein said particular point in the characteristic of the current in the coil corresponds to the first reversal of induced current in the coils, and wherein said detecting means comprises a detector of the direction of the current in the coil.

9. A timepiece according to claim 8, wherein said detector of the direction of the current in the coil comprises two amplifiers, each connected respectively to one of two terminals of the coil, and wherein said driver circuit is rendered inoperative in response to operation of the two amplifiers so as not to interfere with their operation, the outputs of said amplifiers being then representative of the direction of the current in the coil.

10. A timepiece according to claim 9, wherein said amplifiers have negative feedback so as to allow normal flow of the induced current in the coil during the time when the driver circuit is inoperative.

11. A timepiece according to claim 8, wherein said motor control device further includes a safety circuit comprising a measuring circuit connected to the output of the coil current direction detector for measuring the duration of the half-wave of the induced current after said first reversal of this current and a making-up circuit for applying an additional driving pulse of high energy to the coil when said duration exceeds a predetermined value.

12. A timepiece comprising a stepping motor including a coil and a rotor;

an oscillator for providing a standard frequency signal;

a frequency divider connected to said oscillator for dividing down said standard frequency signal and delivering a plurality of periodic signals of different frequencies;

a motor control device connected to said frequency divider and comprising a driver circuit for applying current driving pulses to said coil; and detecting means for delivering a signal when a particular point in the characteristic of the current in the coil appears, the time of the appearance of said particular point being in relation with the load of the motor;

the said motor control device further including control means receiving the signal delivered by said detecting means and acting on said driver circuit to vary the duration of said driving pulses in dependence on the time of the appearance of said signal delivered by said detecting means, said control means including a first control circuit which compares the time of appearance of said signal from said detecting means with a reference time fixed with respect to the driving pulse, and a second control circuit associated with said comparator circuit to cause the appearance of said signal from said detecting means to coincide with said reference time.

13. A timepiece according to claim 12, wherein said reference time is fixed with respect to the start of the driving pulse when the duration of said pulse is larger than a predetermined value and to the end of the driving pulse when the duration of said driving pulse is smaller than said predetermined value.

* * * * *